US009689118B2

(12) United States Patent
Comer et al.

(10) Patent No.: US 9,689,118 B2
(45) Date of Patent: Jun. 27, 2017

(54) APPARATUS AND METHOD FOR A JOINT DENSITY BOLT-ON ASSEMBLY

(71) Applicant: Carlson Paving Products, Inc., Tacoma, WA (US)

(72) Inventors: Kevin Comer, Puyallup, WA (US); Thomas Travers, Clarkston, MI (US)

(73) Assignee: Carlson Paving Products, Inc., Tacoma, WA (US)

( * ) Notice: Subject to any disclaimer, the term of this patent is extended or adjusted under 35 U.S.C. 154(b) by 20 days.

(21) Appl. No.: 14/932,136

(22) Filed: Nov. 4, 2015

(65) Prior Publication Data

US 2016/0122954 A1 May 5, 2016

Related U.S. Application Data

(60) Provisional application No. 62/074,965, filed on Nov. 4, 2014.

(51) Int. Cl.
*E01C 19/48* (2006.01)

(52) U.S. Cl.
CPC ..... *E01C 19/48* (2013.01); *E01C 2301/20* (2013.01)

(58) Field of Classification Search
CPC ..... E01C 19/48; E01C 2301/20
USPC ..... 404/72, 84.8, 96, 101, 105, 118
See application file for complete search history.

(56) References Cited

U.S. PATENT DOCUMENTS

| | | | | |
|---|---|---|---|---|
| 5,344,254 | A * | 9/1994 | Sartain | E01C 19/48 404/104 |
| 6,283,672 | B1 * | 9/2001 | Sovik | E01C 19/48 404/118 |
| 6,923,594 | B2 * | 8/2005 | Sovik | E01C 19/4893 404/104 |
| 6,988,850 | B2 * | 1/2006 | Sovik | E01C 19/4893 404/96 |
| 8,491,221 | B1 * | 7/2013 | Hedin | E01C 19/48 404/104 |
| 8,591,142 | B2 * | 11/2013 | Mittleman | E01C 19/48 404/96 |
| 8,757,923 | B1 * | 6/2014 | Comer | E01C 19/48 404/104 |
| 9,127,414 | B2 * | 9/2015 | Steinhagen | E01C 19/48 |
| 9,290,892 | B2 * | 3/2016 | Vaske | E01C 19/42 |
| 9,290,893 | B2 * | 3/2016 | Mittleman | E01C 19/48 |

* cited by examiner

*Primary Examiner* — Raymond W Addie
(74) *Attorney, Agent, or Firm* — Chambliss, Bahner & Stophel, P.C.

(57) ABSTRACT

A joint density assembly adapted for use on a screed comprising an endgate having a vertical axis, a frame mounted to the screed, a mounting means adapted to mount the frame to the screed, and a fixed shoe, a bolt-on unit mounted to the screed and disposed between the screed and the endgate, and a means for adjusting the bolt-on unit between a downward position and an upward position. A method for increasing the density of an asphalt longitudinal joint comprising providing a joint density assembly and adjusting the bolt-on unit.

18 Claims, 9 Drawing Sheets

APPARATUS AND METHOD FOR A JOINT DENSITY BOLT-ON ASSEMBLY

CROSS-REFERENCES TO RELATED APPLICATIONS/PATENTS

This application relates back to and claims the benefit of priority from U.S. Provisional Application for Patent Ser. No. 62/074,965 entitled "Joint Density Assembly" and filed on Nov. 4, 2014.

FIELD OF THE INVENTION

The present invention relates generally to endgate assemblies, and particularly to endgate assemblies adapted for use on screeds.

BACKGROUND AND DESCRIPTION OF THE PRIOR ART

It is known to use endgates to produce asphalt longitudinal joints. Conventional endgates, however, suffer from one or more disadvantages. For example, conventional endgates produce asphalt longitudinal joints having a lower density than the density of the main asphalt bed. As a result, the asphalt longitudinal joints deteriorate faster than the main asphalt bed and cause unsafe road conditions. Conventional endgates are also expensive and require time-consuming and labor-intensive processes to increase the density of asphalt longitudinal joints. As a result, conventional endgates undesirably increase costs, decrease project completion rates, and raise safety issues.

It would be desirable, therefore, if an apparatus and method for a joint density assembly could be provided that would not produce asphalt longitudinal joints having a lower density than the density of the main asphalt bed. It would also be desirable if such an apparatus and method for a joint density assembly could be provided that would not produce asphalt longitudinal joints that deteriorate faster than the main asphalt bed and cause unsafe road conditions. It would be further desirable if such an apparatus and method for a joint density assembly could be provided that would be less expensive and require less time and labor to increase the density of asphalt longitudinal joints.

ADVANTAGES OF THE PREFERRED EMBODIMENTS OF THE INVENTION

Accordingly, it is an advantage of the preferred embodiments of the invention claimed herein to provide an apparatus and method for a joint density assembly that produces asphalt longitudinal joints having a density equal to the density of the main asphalt bed. It is also an advantage of the preferred embodiments of the invention claimed herein to provide an apparatus and method for a joint density assembly that produces asphalt longitudinal joints that do not deteriorate faster than the main asphalt bed or cause unsafe road conditions. It is another advantage of the preferred embodiments of the invention claimed herein to provide an apparatus and method for a joint density assembly that is less expensive and requires less time and labor to increase the density of asphalt longitudinal joints.

Additional advantages of the preferred embodiments of the invention will become apparent from an examination of the drawings and the ensuing description.

SUMMARY OF THE INVENTION

The apparatus of the invention comprises a joint density assembly adapted for use on a screed. The preferred joint density assembly comprises an endgate having a vertical axis, a frame that is mounted to the screed, a mounting means that is adapted to mount the frame to the screed, and a fixed shoe. The preferred joint density assembly also comprises a bolt-on unit that is mounted to the screed, and a means for adjusting the bolt-on unit between a downward position and an upward position. In the preferred embodiments of the joint density assembly, the bolt-on unit is disposed between the screed and the endgate.

The method of the invention comprises a method for increasing the density of an asphalt longitudinal joint. The preferred method comprises providing a joint density assembly adapted for use on a screed. The preferred joint density assembly comprises an endgate having a vertical axis, a frame that is mounted to the screed, a mounting means that is adapted to mount the frame to the screed, and a fixed shoe. The preferred joint density assembly also comprises a bolt-on unit that is mounted to the screed, and a means for adjusting the bolt-on unit between a downward position and an upward position. In the preferred embodiments of the joint density assembly, the bolt-on unit is disposed between the screed and the endgate. The preferred method also comprises adjusting the bolt-on unit.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
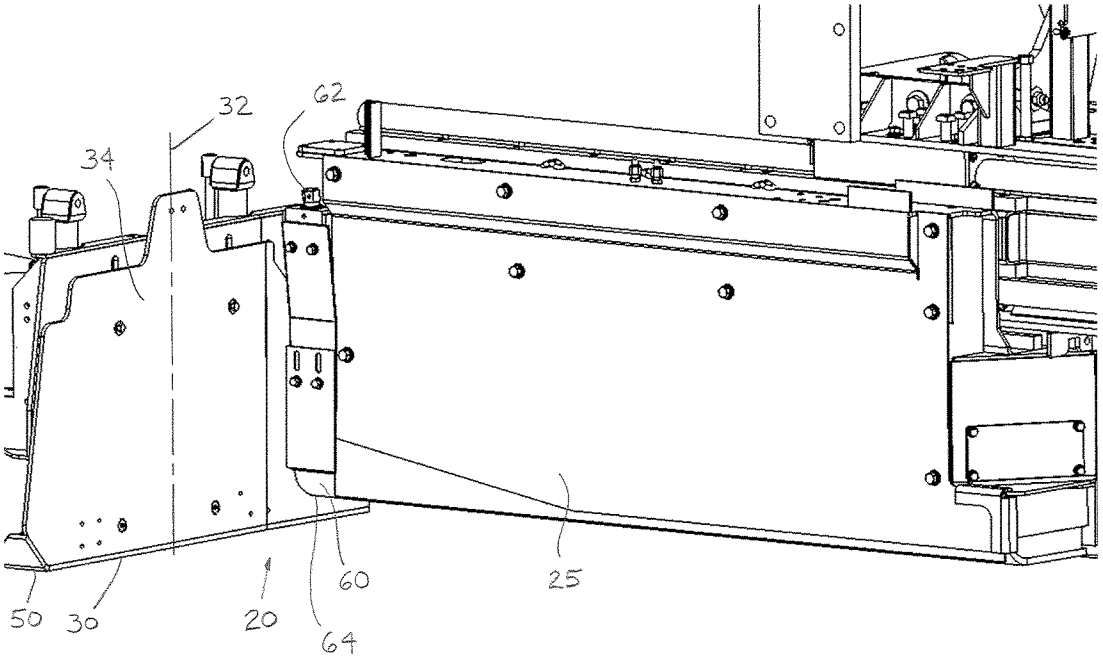
FIG. 1 is a perspective front end view of the preferred embodiment of the joint density assembly in accordance with the present invention mounted on an exemplary screed showing the bolt-on unit in a downward position.

Referring now to the drawings, the preferred embodiments of the joint density assembly in accordance with the present invention are illustrated by FIGS. 1 through 9. As shown in FIGS. 1-9, the preferred embodiments of the invention claimed herein are adapted to provide an apparatus and method for a joint density assembly that produces asphalt longitudinal joints having a density equal to the density of the main asphalt bed. The preferred embodiments of the invention claimed herein are also adapted to provide an apparatus and method for a joint density assembly that produces asphalt longitudinal joints that do not deteriorate faster than the main asphalt bed or cause unsafe road conditions. The preferred embodiments of the invention claimed herein are further adapted to provide an apparatus and method for a joint density assembly that is less expensive and requires less time and labor to increase the density of asphalt longitudinal joints.

Referring now to FIG. 1, a perspective front end view of the preferred embodiment of the joint density assembly in accordance with the present invention is illustrated mounted on an exemplary screed showing the bolt-on unit in a downward position. As shown in FIG. 1, the preferred joint density assembly is designated generally by reference numeral 20. Preferred joint density assembly 20 is adapted to be removably mounted on exemplary screed 25 and comprises endgate 30 having vertical axis 32, frame 34, and fixed shoe 50. In addition, preferred joint density assembly 20 comprises bolt-on unit 60. Preferred bolt-on unit 60 is disposed between endgate 30 and screed 25 and is pivotally mounted to screed 25. Preferably, bolt-on unit 60 is adapted to be adjusted independently from the adjustment of endgate 30. More particularly, preferred bolt-on unit 60 has an adjustable angle of attack which can be moved between a downward position (see also FIGS. 3 and 5) and an upward position (see also FIGS. 2, 4, and 6) by a means for adjusting the bolt-on unit such as jack screw 62 (see also FIGS. 2-6). Preferred bolt-on unit also comprises asphalt-contacting surface 64.

While FIG. 1 illustrates the preferred configuration and arrangement of the joint density assembly, it is contemplated within the scope of the invention that the joint density assembly may be of any suitable configuration and arrangement. More particularly, it is contemplated within the scope of the invention that the means for adjusting the bolt-on unit may comprise any suitable threaded fastener, an actuator, a cylinder, and/or any other suitable device, mechanism, assembly, or combination thereof. It is also contemplated within the scope of the invention that the adjustment of the bolt-on unit may correlate to the adjustment of the endgate.

Figure 2:
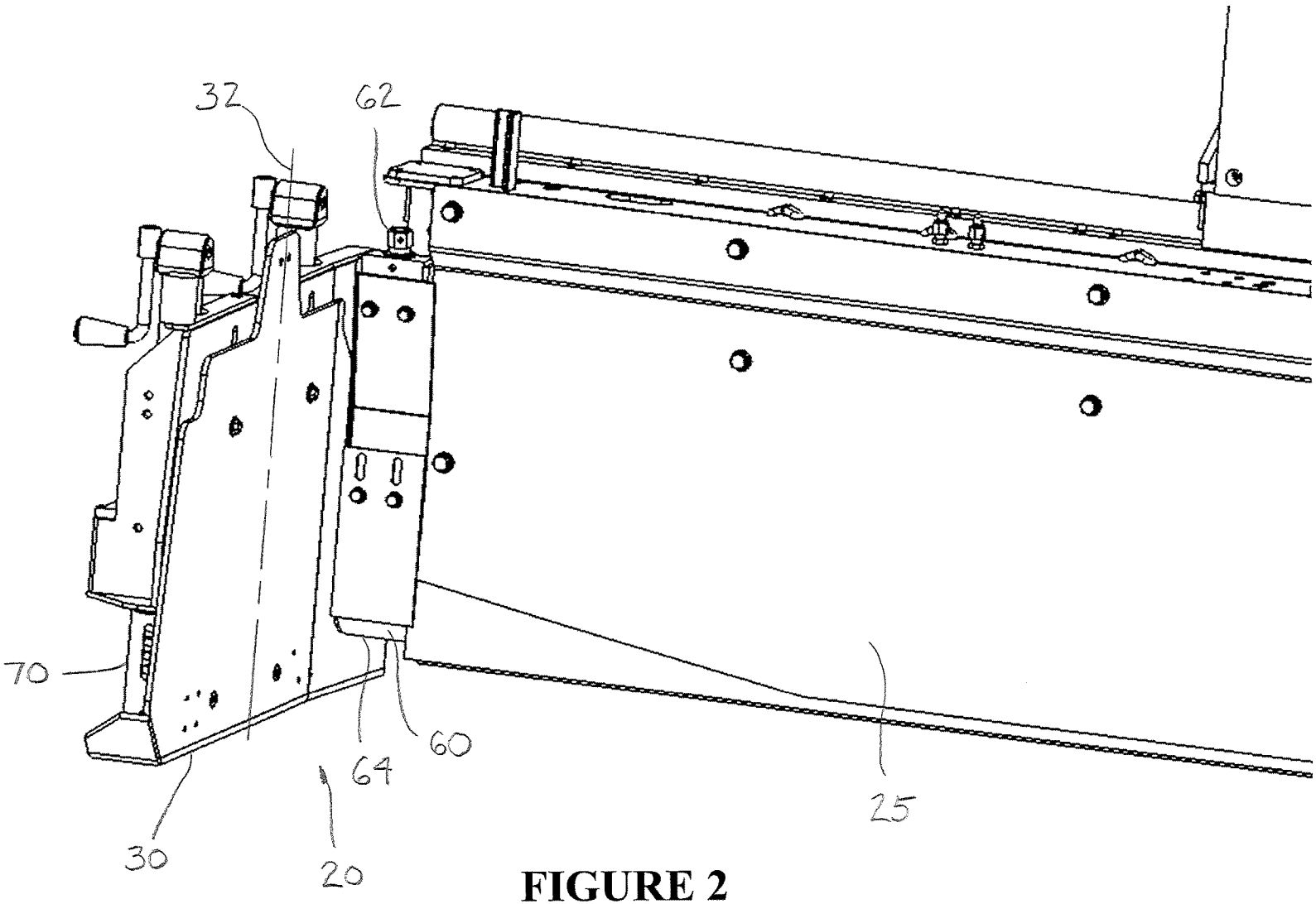
FIG. 2 is a perspective front end view of the preferred joint density assembly illustrated in FIG. 1 showing the bolt-on unit in an upward position.

Referring now to FIG. 2, a perspective front end view of preferred joint density assembly 20 is illustrated showing the bolt-on unit in an upward position. As shown in FIG. 2, preferred joint density assembly 20 comprises endgate 30, bolt-on unit 60, jack screw 62, asphalt-contacting surface 64, and hold-down assembly 70. In the upward position, preferred bolt-on unit 60 is adapted to allow more asphaltic material into an asphalt longitudinal joint, thereby increasing the asphalt longitudinal joint density. More particularly, the screed plate 80 (see FIGS. 3 and 4) disposed behind preferred bolt-on unit 60 is adapted to apply a vertical force that is parallel to vertical axis 32 of endgate 30 so as to increase the pressure applied to the horizontal surface adjacent to the asphalt longitudinal joint, thereby increasing the density of the joint. By contrast, when preferred bolt-on unit 60 is in the downward position, less asphaltic material enters the area of the asphalt longitudinal joint.

Figure 3:
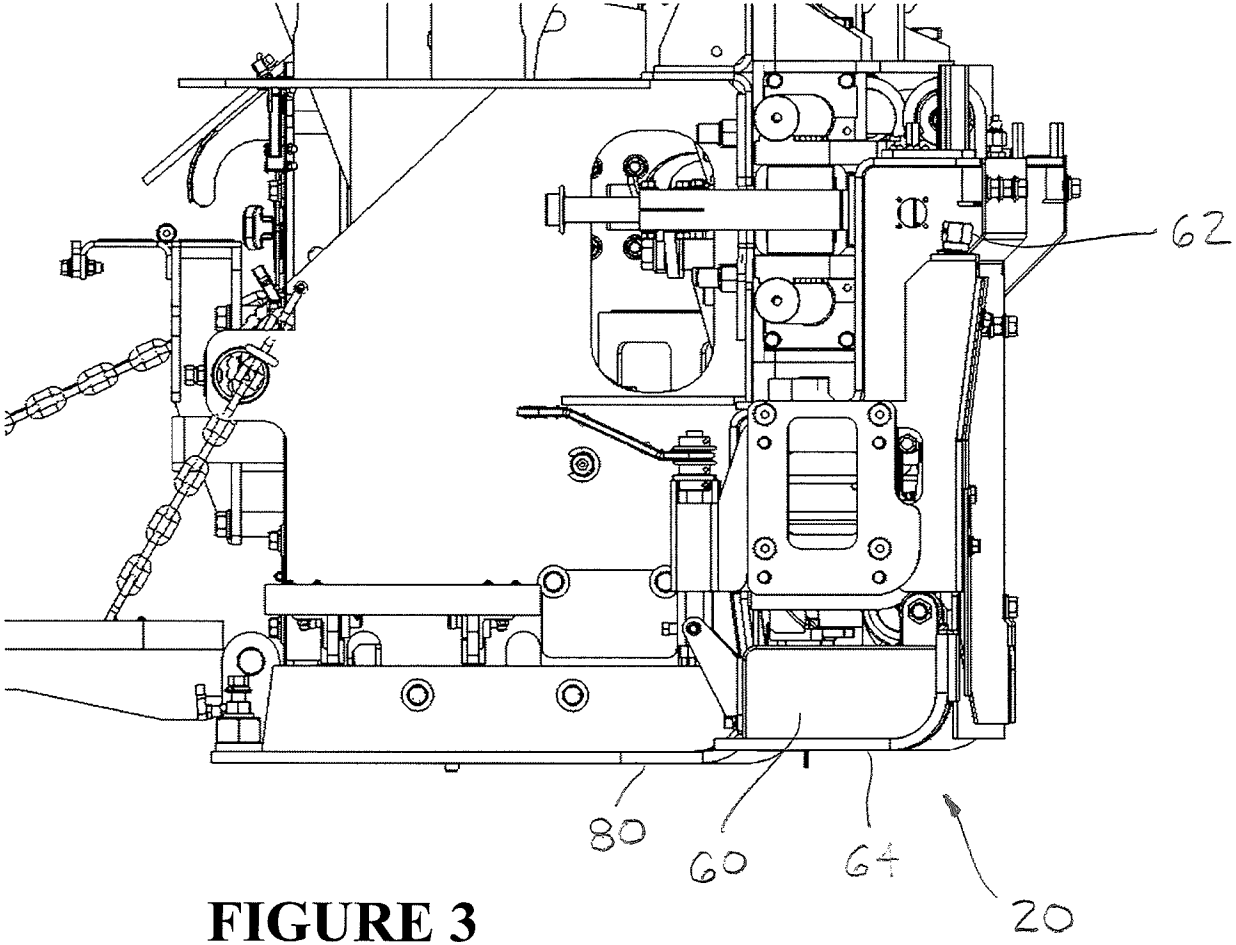
FIG. 3 is a left side view of the preferred embodiment of the joint density assembly illustrated in FIGS. 1-2 with the endgate removed and the bolt-on unit in a downward position.

Referring now to FIG. 3, a left side view of joint density assembly 20 is illustrated with endgate 30 removed and bolt-on unit 60 in a downward position. As shown in FIG. 3, preferred bolt-on unit 60 comprises a means for adjusting the bolt-on unit such as jack screw 62 and asphalt contacting surface 64.

Figure 4:
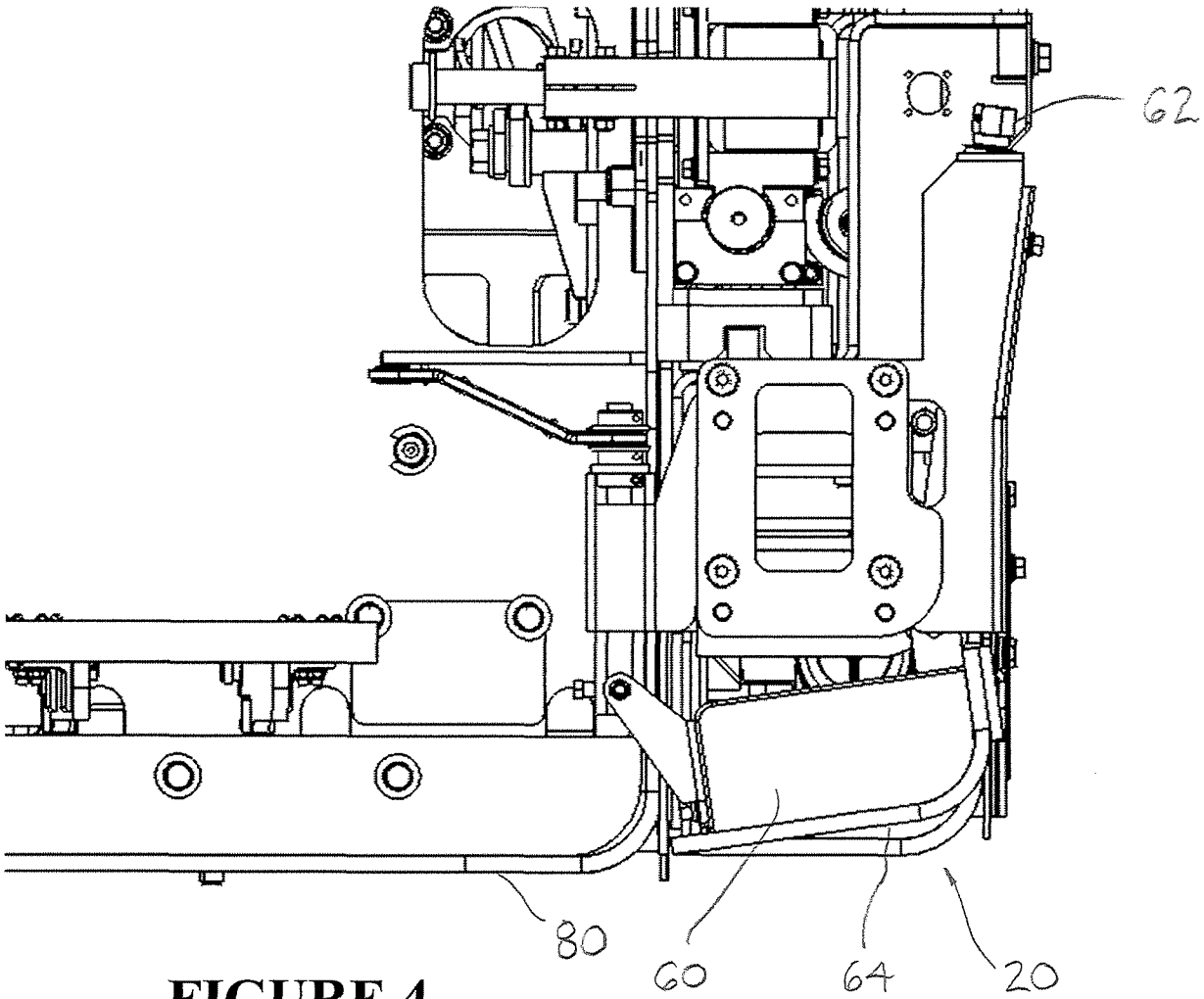
FIG. 4 is a left side view of the preferred embodiment of the joint density assembly illustrated in FIGS. 1-3 with the endgate removed and the bolt-on unit in an upward position.

Referring now to FIG. 4, a left side view of joint density assembly 20 is illustrated with endgate 30 removed and bolt-on unit 60 in an upward position. As shown in FIG. 4, preferred bolt-on unit 60 comprises a means for adjusting the bolt-on unit such as jack screw 62 and asphalt contacting surface 64.

Figure 5:
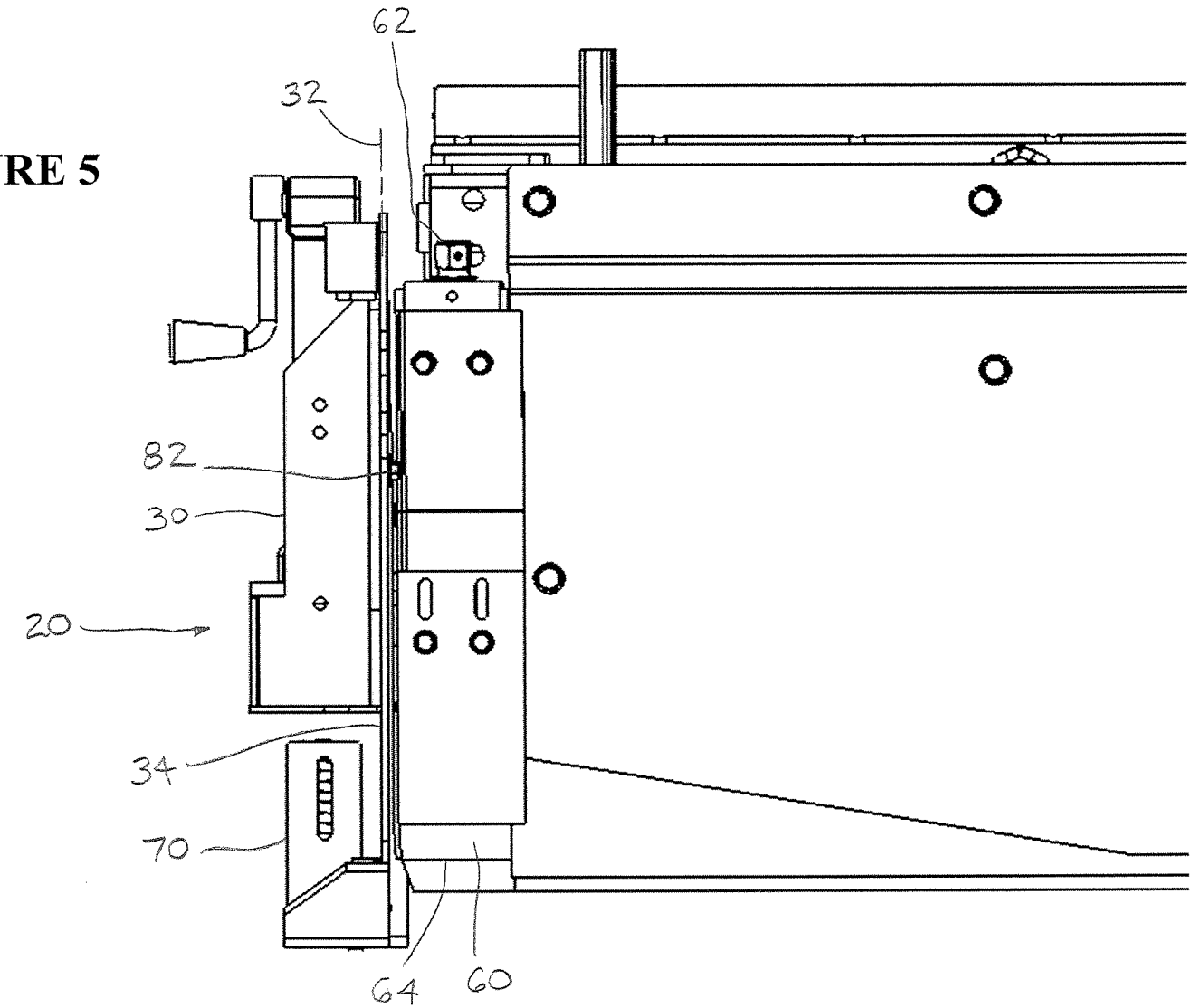
FIG. 5 is a front end view of the preferred joint density assembly illustrated in FIGS. 1-4 showing the bolt-on unit in a downward position.

Referring now to FIG. 5, a front end view of preferred joint density assembly 20 is illustrated showing bolt-on unit 60 in a downward position. As shown in FIG. 5, preferred joint density assembly 20 comprises endgate 30 having vertical axis 32, frame 34, hold-down assembly 70, a mounting means such as bolts 82, bolt-on unit 60, jack screw 62, and asphalt-contacting surface 64.

Figure 6:
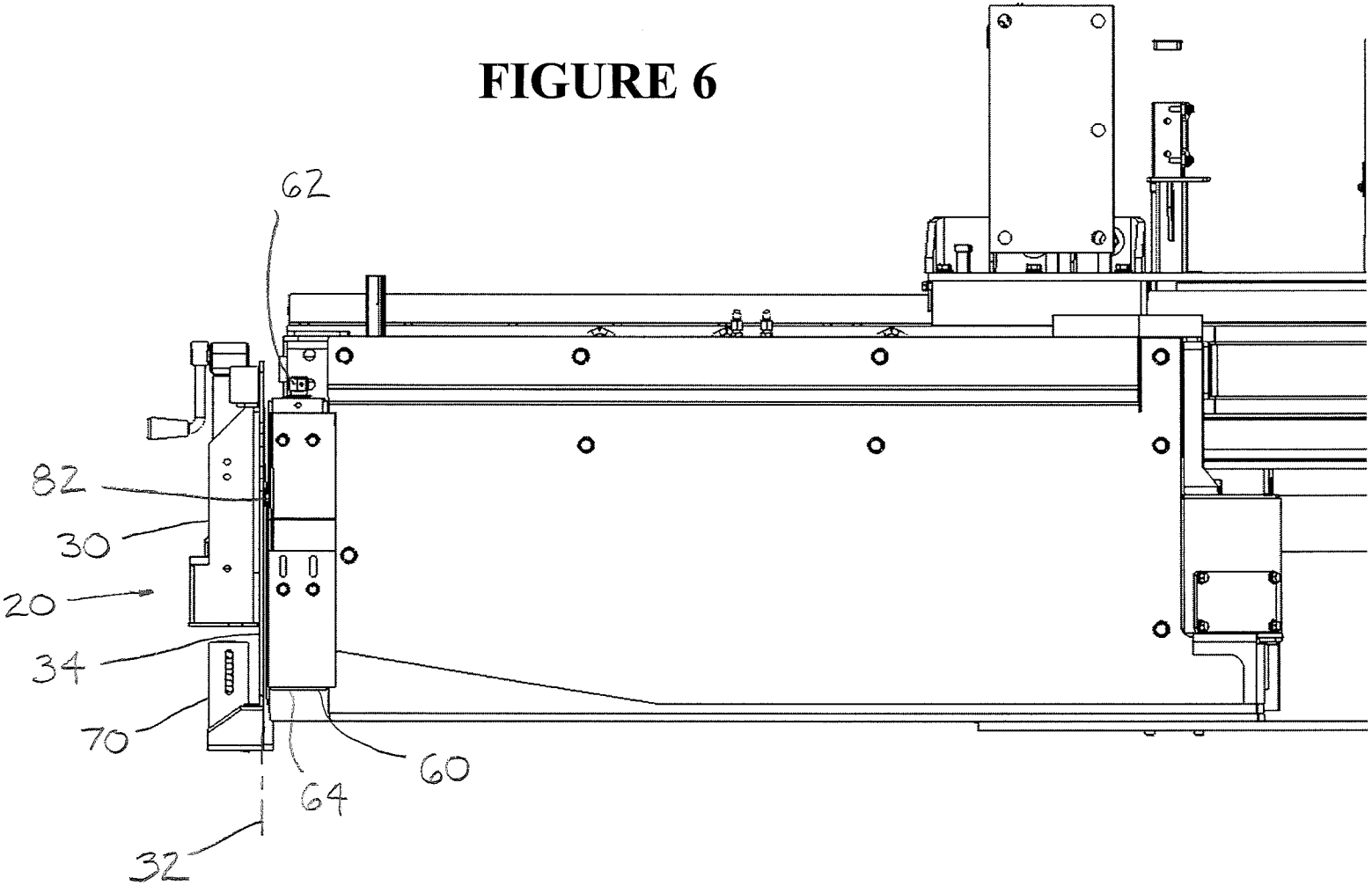
FIG. 6 is a front end view of the preferred joint density assembly illustrated in FIGS. 1-5 showing the bolt-on unit in an upward position.

Referring now to FIG. 6, a front end view of preferred joint density assembly 20 is illustrated showing bolt-on unit 60 in an upward position. As shown in FIG. 6, preferred joint density assembly 20 comprises endgate 30 having vertical axis 32, frame 34, hold-down assembly 70, and a mounting means such as bolts 82, bolt-on unit 60, jack screw 62, and asphalt-contacting surface 64.

Figure 7:
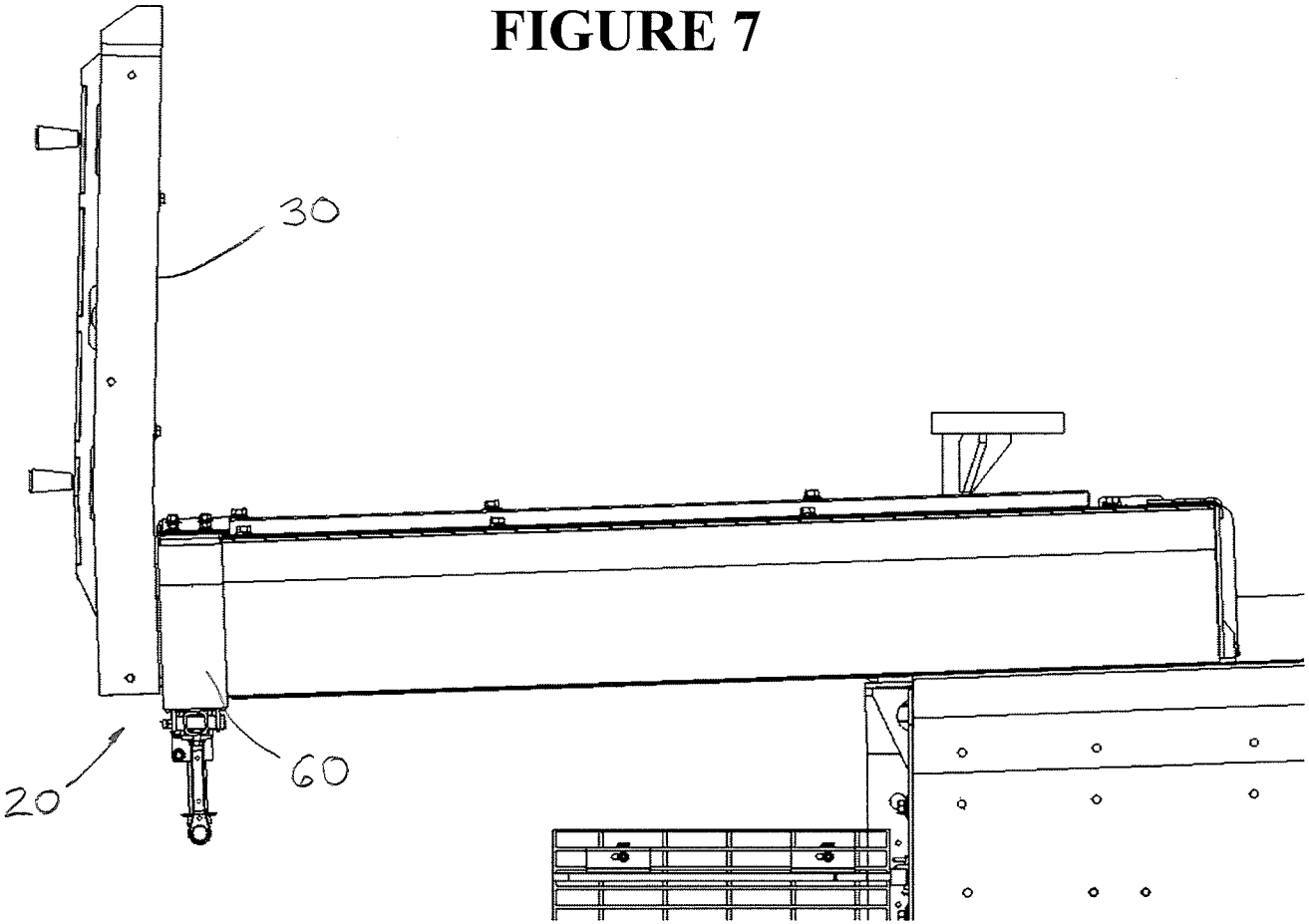
FIG. 7 is a bottom view of the preferred joint density assembly illustrated in FIGS. 1-6.

Referring now to FIG. 7, a bottom view of preferred joint density assembly 20 is illustrated. As shown in FIG. 7, preferred joint density assembly 20 comprises endgate 30 and bolt-on unit 60.

Figure 8:
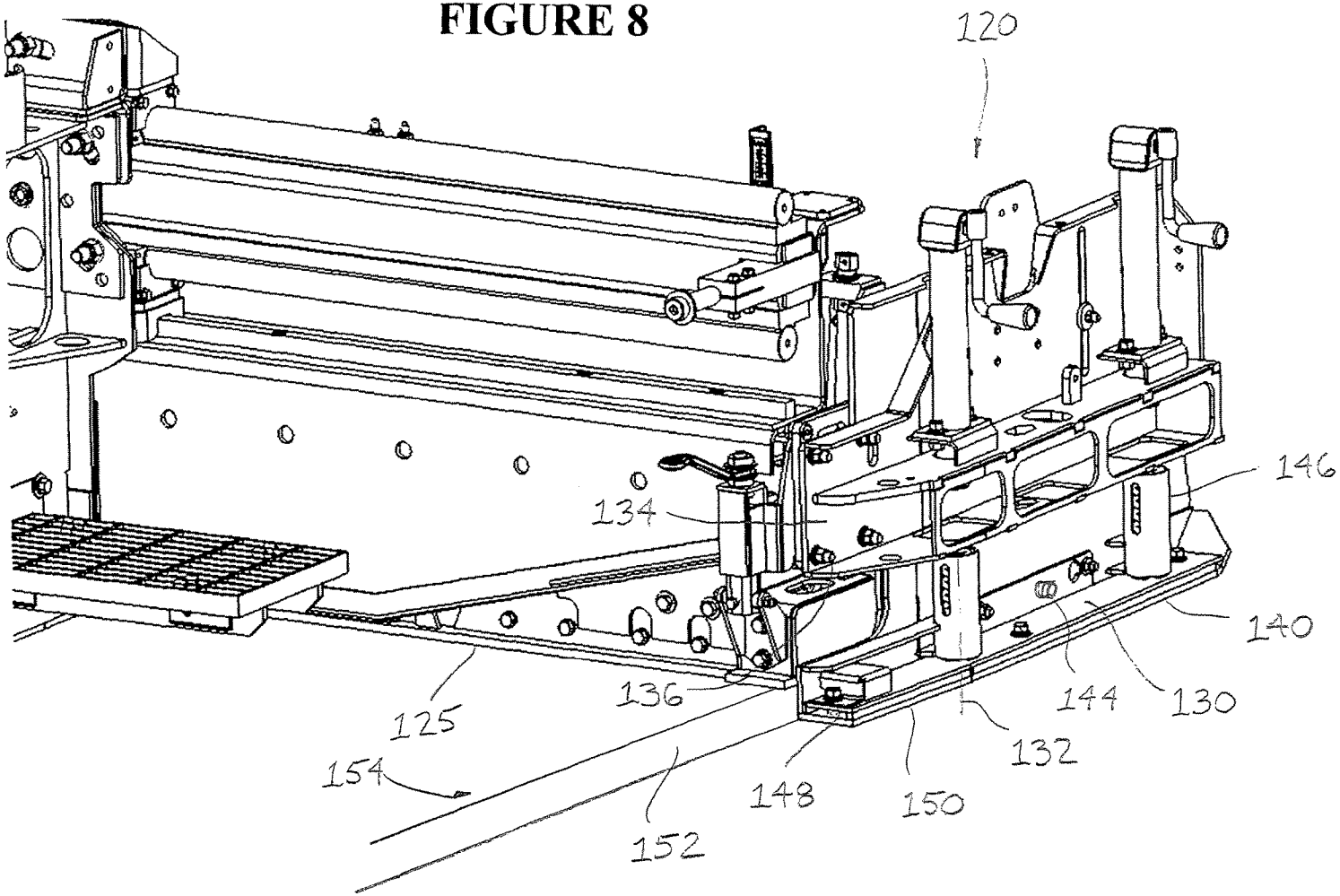
FIG. 8 is a perspective rear end view of a first alternative embodiment of the joint density assembly in accordance with the present invention.

Referring now to FIG. 8, a perspective rear end view of a first alternative embodiment of the joint density assembly in accordance with the present invention is illustrated. As shown in FIG. 8, the preferred joint assembly is designated generally by reference numeral 120. Preferred joint density assembly 120 is adapted for use on exemplary screed 125 and comprises endgate 130. Preferred endgate 130 has vertical axis 132, frame 134, a mounting means such as bolts 136, pivoting shoe 140, a means for adjusting the pivoting shoe such as jack screw 144, hold-down assembly 146, heating element 148, and fixed shoe 150. Preferably, pivoting shoe 140 is adapted to be pivotally adjusted by jack screw 144 and moved between a retracted position and an extended position (see FIG. 9) about vertical axis 132 of endgate 130. Preferred pivoting shoe 140 is adapted to allow more asphaltic material into outer vertical edge 152 of asphalt longitudinal joint 154. Preferably, joint density assembly 120 is adapted to increase an asphalt longitudinal joint density. More particularly, preferred endgate 130 is adapted to apply a horizontal force that is transverse or normal to vertical axis 132 so as to increase the pressure applied to outer vertical edge 152 of the asphalt longitudinal joint 154, thereby increasing the density of the joint. Preferred frame 134 is removably mounted to screed 125 by a mounting means such as bolts 136. Preferred hold-down assembly 146 comprises a spring disposed in a tube and is adapted to "float" so that it can follow the contour of the ground below pivoting shoe 140. Preferably, fixed shoe 150 is disposed behind pivoting shoe 140, i.e., rearward from the direction of travel of joint density assembly 120.

While FIG. 8 illustrates the preferred configuration and arrangement of the joint density assembly in accordance with the present invention, it is contemplated within the scope of the invention that the joint density assembly may be of any suitable configuration and arrangement. More particularly, it is contemplated within the scope of the invention that the mounting means may comprise any suitable threaded fasteners, pin and wedge combinations, quick attach systems, and/or any other suitable device, mechanism, assembly, or combination thereof for removably mounting the endgate on a screed. It is also contemplated within the scope of the invention that the endgate may be fixedly mounted on the screed such as by welding, rivets, and the like. In addition, it is contemplated within the scope of the invention that the means for adjusting the pivoting shoe may comprise any suitable threaded fastener, actuator, cylinder, and/or any other suitable device, mechanism, assembly, or combination thereof. It is further contemplated within the scope of the invention that the hold-down assembly comprises an actuator, a cylinder, and/or any other suitable device, mechanism, assembly, or combination thereof. It is still further contemplated within the scope of the invention that the joint density assembly does not comprise a heating element or a hold-down assembly.

Figure 9:
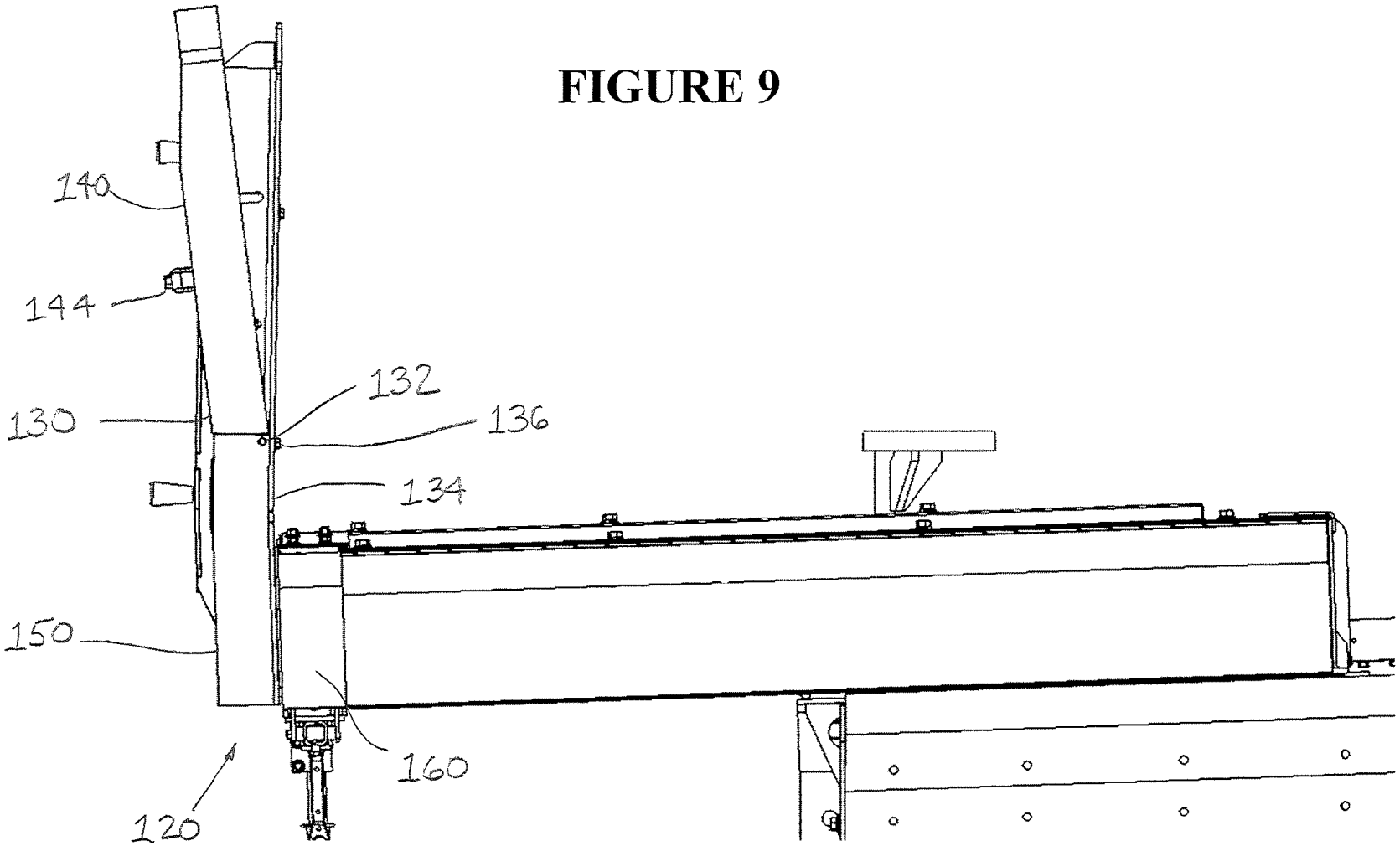
FIG. 9 is a bottom view of the first alternative embodiment of the joint density assembly illustrated in FIG. 8 showing the pivoting shoe in an extended position.

Referring now to FIG. 9, a bottom view of preferred joint density assembly 120 is illustrated showing pivoting shoe 140 in an extended position. As shown in FIG. 9, preferred joint density assembly 120 comprises endgate 130, vertical axis 132, frame 134, a mounting means such as bolts 136, pivoting shoe 140, a means for adjusting the pivoting shoe such as jack screw 144, fixed shoe 150, and bolt-on unit 160. When preferred pivoting shoe 140 is in the extended position, the amount of asphaltic material in the area of the outer vertical edge of the asphalt longitudinal joint is maximized. As a result, when preferred pivoting shoe 140 is in the extended position, joint density assembly 120 is adapted to increase the asphalt longitudinal joint density. While FIG. 9 illustrates the pivoting shoe in the preferred extended position, it is contemplated within the scope of the invention that the pivoting shoe may be moved into any suitable extended position.

The invention also comprises a method for increasing the density of a longitudinal asphalt joint. The preferred method comprises providing a joint density assembly adapted for use on a screed. The preferred joint density assembly comprises an endgate having a vertical axis, a frame, a mounting means, a hold-down assembly, a heating element, and a fixed shoe, a bolt-on unit, and a means for an adjusting the bolt-on unit. The preferred frame is removably mounted to the screed by a mounting means. The preferred hold-down assembly comprises a spring disposed in a tube and is adapted to "float" so that it can follow the contour of the ground below the pivoting shoe. Preferably, the bolt-on unit is disposed between the endgate and the screed. The preferred bolt-on unit has an adjustable angle of attack which can be moved between a downward position and an upward position by the means for adjusting the bolt-on unit. In the upward position, the preferred bolt-on unit is adapted to allow more asphaltic material into an asphalt longitudinal joint, thereby increasing the asphalt longitudinal joint density. More particularly, the preferred bolt-on unit is adapted to apply a vertical force that is parallel to the vertical axis of the endgate so as to increase the pressure applied to the horizontal surface adjacent to the asphalt longitudinal joint, thereby increasing the density of the joint. By contrast, when the preferred bolt-on unit is in the downward position, less asphaltic material enters the area of the asphalt longitudinal joint. The preferred method also comprises adjusting the bolt-on unit.

In an alternative method, the joint density assembly further comprises an endgate having a pivoting shoe. Preferably, the pivoting shoe is adapted to be pivotally adjusted by a means for adjusting the pivoting shoe and moved between a retracted position and an extended position about the vertical axis of the endgate. The preferred pivoting shoe is adapted to allow more asphaltic material into an outer vertical edge of an asphalt longitudinal joint. Preferably, the joint density assembly is adapted to increase an asphalt longitudinal joint density. More particularly, the preferred endgate is adapted to apply a horizontal force that is transverse or normal to its vertical axis so as to increase the pressure applied to the outer vertical edge of the asphalt longitudinal joint, thereby increasing the density of the joint. Preferably, the fixed shoe is disposed behind the pivoting shoe, i.e., rearward from the direction of travel of the joint density assembly. The preferred alternative method also comprises adjusting the pivoting shoe of the endgate.

In operation, several advantages of the preferred embodiments of the joint density assembly are achieved. For example, the preferred embodiments of the invention claimed herein are adapted to provide an apparatus and method for a joint density assembly that includes an adjustable bolt-on unit which is adapted to produce asphalt longitudinal joints having a density equal to the density of the main asphalt bed. In addition, in some preferred embodiments, the assembly also comprises an adjustable pivoting shoe which is adapted to produce asphalt longitudinal joints having a density equal to the density of the main asphalt bed. The preferred embodiments of the invention claimed herein are also adapted to provide an apparatus and method for a joint density assembly that produces asphalt longitudinal joints that do not deteriorate faster than the main asphalt bed or cause unsafe road conditions. The preferred embodiments of the invention claimed herein are further adapted to provide an apparatus and method for a joint density assembly that is less expensive and requires less time and labor to increase the density of asphalt longitudinal joints.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. A joint density assembly adapted for use on a screed, said joint density assembly comprising:

(a) an endgate, said endgate having a vertical axis and comprising:
  (1) a frame, said frame being mounted to the screed;
  (2) a mounting means, said mounting means being adapted to mount the frame to the screed;
  (3) a fixed shoe;
  (4) a pivoting shoe, said pivoting shoe being disposed in front of the fixed shoe;

(b) a bolt-on unit, said bolt-on unit being mounted to the screed;

(c) a means for adjusting the bolt-on unit, said means for adjusting the bolt-on unit being adapted to adjust the bolt-on unit between a downward position and an upward position;

wherein the bolt-on unit is disposed between the screed and the endgate.

2. The joint density assembly of claim 1 wherein the assembly is removably mounted on the screed.

3. The joint density assembly of claim 1 wherein the mounting means comprises a threaded fastener.

4. The joint density assembly of claim 1 wherein the bolt-on unit is pivotally mounted to the screed.

5. The joint density assembly of claim 1 wherein the means for adjusting the bolt-on unit comprises a jack screw.

6. The joint density assembly of claim 1 wherein the bolt-on unit is adapted to be independently adjusted.

7. The joint density assembly of claim 1 wherein the bolt-on unit has an angle of attack that is adapted to be adjusted.

8. The joint density assembly of claim 1 wherein the bolt-on unit is adapted to be adjusted to allow more asphaltic material into an asphalt longitudinal joint.

9. The joint density assembly of claim 1 wherein the bolt-on unit is adapted to increase an asphalt longitudinal joint density.

10. The joint density assembly of claim 1 wherein the endgate further comprises a hold-down assembly.

11. The joint density assembly of claim 10 wherein the hold-down assembly comprises a spring.

12. The joint density assembly of claim 1 further comprising a heating element.

13. The joint density assembly of claim 1 wherein the pivoting shoe is adapted to allow more asphaltic material into an outer vertical edge of an asphalt longitudinal joint.

14. The joint density assembly of claim 1 wherein the pivoting shoe is adapted to increase an asphalt longitudinal joint density.

15. The joint density assembly of claim 1 further comprising a means for adjusting the pivoting shoe.

16. The joint density assembly of claim 1 wherein the means for adjusting the pivoting shoe comprises a jack screw.

17. A method for increasing the density of an asphalt longitudinal joint, said method comprising:

(a) providing a joint density assembly adapted for use on a screed, said joint density assembly comprising:

(1) an endgate, said endgate having a vertical axis and comprising:

(i) a frame, said frame being mounted to the screed;

(ii) a mounting means, said mounting means being adapted to mount the frame to the screed;

(iii) a fixed shoe;

(iv) a pivoting shoe, said pivoting shoe being disposed in front of the fixed shoe;

(2) a bolt-on unit, said bolt-on unit being mounted to the screed;

(3) a means for adjusting the bolt-on unit, said means for adjusting the bolt-on unit being adapted to adjust the bolt-on unit between a downward position and an upward position;

wherein the bolt-on unit is disposed between the screed and the endgate;

(b) adjusting the bolt-on unit.

18. The method of claim 17 wherein the endgate comprises a pivoting shoe and further comprising adjusting the pivoting shoe.

* * * * *